US010060601B2

(12) United States Patent
Donnini

(10) Patent No.: US 10,060,601 B2
(45) Date of Patent: Aug. 28, 2018

(54) LIGHTING DEVICE

(71) Applicant: TARGETTI SANKEY S.p.A., Florence (IT)

(72) Inventor: Andrea Donnini, Florence (IT)

(73) Assignee: TARGETTI SANKEY S.P.A., Florence (IT)

( * ) Notice: Subject to any disclaimer, the term of this patent is extended or adjusted under 35 U.S.C. 154(b) by 0 days.

(21) Appl. No.: 15/110,150

(22) PCT Filed: Dec. 30, 2014

(86) PCT No.: PCT/IB2014/067404

§ 371 (c)(1),
(2) Date: Jul. 7, 2016

(87) PCT Pub. No.: WO2015/118397

PCT Pub. Date: Aug. 13, 2015

(65) Prior Publication Data

US 2016/0334079 A1 Nov. 17, 2016

(30) Foreign Application Priority Data

Feb. 4, 2014 (IT) ..... BS2014A0036

(51) Int. Cl.
*F21V 17/02* (2006.01)
*F21V 14/06* (2006.01)
(Continued)

(52) U.S. Cl.
CPC ..... *F21V 14/06* (2013.01); *F21S 8/022* (2013.01); *F21V 5/008* (2013.01); *F21V 5/045* (2013.01);
(Continued)

(58) Field of Classification Search
CPC ..... F21V 14/06; F21V 14/065; F21V 14/08; F21V 14/085; F21V 17/02; F21V 13/14;
(Continued)

(56) References Cited

U.S. PATENT DOCUMENTS 5,416,681 A 5/1995 Wu
5,915,829 A 6/1999 Kalze et al.
(Continued)

FOREIGN PATENT DOCUMENTS

DE 8119544 U1 9/1981
GB 660561 A 11/1951
JP 2012-69370 A 4/2012

OTHER PUBLICATIONS

International Search Report for PCT/IB2014/067404, dated Mar. 20, 2015.

*Primary Examiner* — Y M Lee
(74) *Attorney, Agent, or Firm* — Arent Fox LLP; Michael Fainberg

(57) ABSTRACT

A lighting device, in particular suitable for being embedded in the ground, comprising an external appliance body, of a substantially cylindrical shape, comprising a bottom wall and a side wall which extends from said bottom wall. A lighting source attached to said bottom wall of the external appliance body and suitable to emit a beam of light with a main axis (X), towards a lens suitable to focus said beam of light. Lateral translation means are also provided for suitable to cause a translation of the lens on a lens plane orthogonal to said main axis so as to offset the center of the lens from said main axis, and rotation means suitable to cause a rotation of the offset lens on said lens plane around said main axis.

16 Claims, 6 Drawing Sheets

(51) Int. Cl.

| | |
|---|---|
| ***F21S 8/02*** | (2006.01) |
| ***F21V 5/00*** | (2018.01) |
| ***F21V 5/04*** | (2006.01) |
| ***F21V 13/04*** | (2006.01) |
| ***F21V 29/503*** | (2015.01) |
| ***F21V 17/10*** | (2006.01) |
| ***F21V 17/12*** | (2006.01) |
| *F21V 29/00* | (2015.01) |
| *F21V 15/01* | (2006.01) |
| *F21Y 115/10* | (2016.01) |

(52) U.S. Cl.
CPC ..... *F21V 13/04* (2013.01); *F21V 17/02* (2013.01); *F21V 17/102* (2013.01); *F21V 17/104* (2013.01); *F21V 17/12* (2013.01); *F21V 29/503* (2015.01); *F21V 15/01* (2013.01); *F21V 29/004* (2013.01); *F21Y 2115/10* (2016.08)

(58) Field of Classification Search
CPC . F21V 13/04; F21V 5/08; F21V 5/045; F21V 5/008; F21V 15/01; F21V 17/102; F21V 17/104; F21V 17/12; F21V 2131/406; F21S 8/022; F21S 8/02
See application file for complete search history.

(56) References Cited

U.S. PATENT DOCUMENTS

| | | | | |
|---|---|---|---|---|
| 7,347,588 | B2 * | 3/2008 | Weigert | F21V 14/06 362/282 |
| 2003/0076681 | A1 * | 4/2003 | Rasmussen | F21S 10/007 362/280 |
| 2004/0114355 | A1 * | 6/2004 | Rizkin | F21V 5/04 362/373 |
| 2006/0187654 | A1 | 8/2006 | Jungel-Schmid et al. | |
| 2011/0249442 | A1 | 10/2011 | Jurik et al. | |
| 2012/0121244 | A1 | 5/2012 | Stavely | |
| 2015/0029707 | A1 * | 1/2015 | Cheng | F21V 14/065 362/187 |

* cited by examiner

LIGHTING DEVICE

FIELD OF TECHNOLOGY

The present invention relates to a lighting device, in particular suitable to be embedded in the floor or in the ground, normally for external use. Said lighting devices, also known by the English term of "inground" or "uplight", are used to illuminate trees, facades, porches, etc. from below upwards.

BACKGROUND

Usually, these embedded appliances are composed of a sealed outer body, closed by a transparent element, for example in glass, crossed by the beam of light of the internal optical system. The appliance is normally equipped with an embedding well that is cemented into the ground to form the compartment in which the appliance is embedded.

The body/well system must meet various requirements, such as a high degree of IP protection, the ability to be walked on/driven over, embedding depth and diameter, IK protection (against shock or acts of vandalism) and theft, maximum temperature of the parts that can be touched, flush or protruding finishing rings, orientability of the beam.

Since the "inground" embedded appliance is designed for installation in an exact point on the ground and/or at a certain distance from the object to be illuminated (wall, tree, etc.), except when the light is widely diffused, the beam of light must be orientable both on the horizontal plane and with respect to a vertical axis. This orientability of the beam of light is also known as pointing.

The ranges of angles covered are normally from −90° to +90° in the horizontal plane and from 0° to 30° with respect to the vertical axis.

As to the first adjustment, achieving horizontal pointing by rotating the outer body in the well is to be avoided since the two elements have a fixed locking system, and to avoid the aesthetic elements of the body or of the outer ring of several appliances in a row from be oriented randomly and/or otherwise.

It is therefore preferable for the internal optical system to be orientable in the two directions.

With traditional sources (discharge lamps, halogen) the orientation of the optical unit is obtained simply by means of "gimbal" systems in various different shapes, but traceable to a rotating interface which houses an oscillating optical body.

As known, with LED light sources the thermal dissipation of the absorbed power not converted into light is crucial. The heat transfer is concentrated at the base of the LED and must be guaranteed to maximise the light output, the efficiency and durability over time of the device and of its performance.

In an inground light, closed by a poorly conductive element (glass and relative attachment ring), the most efficient way to dissipate the heat produced by the source is to transmit it to the surrounding ground through the metal body, the minimum air interspace between the body and the well, and lastly the well itself.

The difficulty is thus to transmit the heat from the LED to the metal body (in general to the external parts) when the LED is mounted on a rotating/oscillating gimbal structure.

Some solutions to this problem have been proposed.

One solution is to limit the ratio between the power of the LEDs and the size of the necessary body (i.e. using low power or enlarging the body); this makes it possible to keep said body and thus the air inside it "colder". This choice, however, is contrary to the small recess size requested in installations and to the production costs.

A second solution is to create large contact sections between the rotating elements and the body. This solution has the disadvantage of requiring heavy and expensive elements and expensive machining (milling, boring) of the contact surfaces to be made.

In a third solution a local, mobile heatsink is used for the LED and the heat exchange with the fixed body is increased via an internal air stirrer, such as a fan. Disadvantages of this solution are the additional costs, possible fan noise, increased exposure to failures, and market distrust of active dissipation.

It is evident therefore that the solutions proposed to date do not definitively solve the problem of heat dissipation of an "inground" lighting device with orientable lighting beam and in particular with an LED lighting source.

SUMMARY

The purpose of the present invention is to propose a lighting device of the "inground" type that can be made with LED lighting sources and which is able to overcome the drawbacks and disadvantages complained of above with reference to the appliances of the prior art.

Such purpose is achieved by a lighting device according to claim 1. The dependent claims describe preferred embodiments of the invention.

BRIEF DESCRIPTION OF THE DRAWINGS

The characteristics and advantages of the lighting device according to the invention will, in any case, be evident from the description given below of its preferred embodiments, made by way of a non-limiting example with reference to the appended drawings, wherein:

FIGS. 1, 1*a* and 1*b* schematically illustrate the principle of optical misalignment which the present invention is based on;

DETAILED DESCRIPTION

Figure 1:
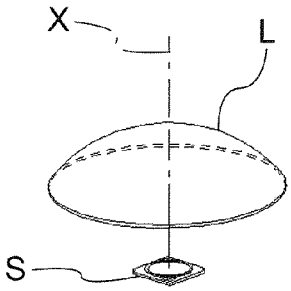
Figure 1A:
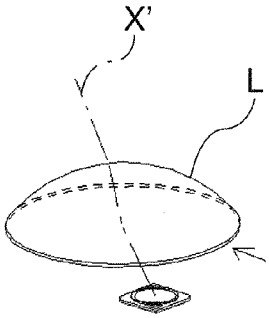
Figure 1B:
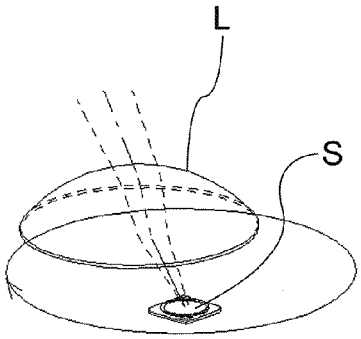

The present invention is based on the principle of optical misalignment of a lens, according to which the beam of light obtained from a source-lens pair tilts rapidly when the lens is moved parallel to the side by even a few millimeters. FIGS. 1, 1*a* and 1*b* schematically illustrate the principle. In said figures, S denotes a lighting source, such as an LED. The source S emits a beam of light towards a lens L. In FIG. 1, the source S and the lens L are coaxial. The lens L lies on a lens plane orthogonal to the emission axis X (for example, a vertical axis) of the beam of light.

In FIG. 1*a*, the lens L is translated along the lens plane and the emission axis X' is inclined compared to the original vertical emission axis X.

The offset lens can then rotate freely on the lens plane with respect to the vertical emission axis X, for example performing a rotation of 360°. The combination of the translation and rotation of the lens on the lens plane makes it possible to achieve any pointing within the predetermined range (FIG. 1*b*).

Figure 2:
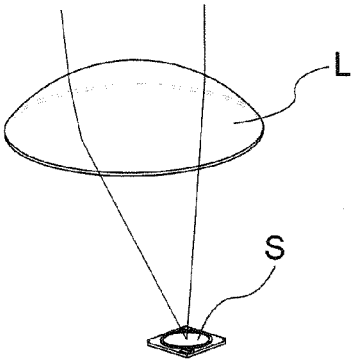
FIGS. 2 and 2*a* schematically illustrate the "zoom" function of a beam of light.
Figure 2A:
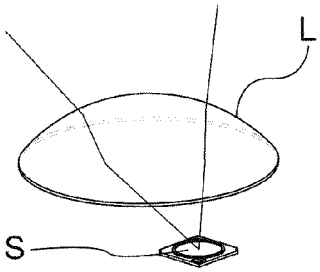
Figure 3:
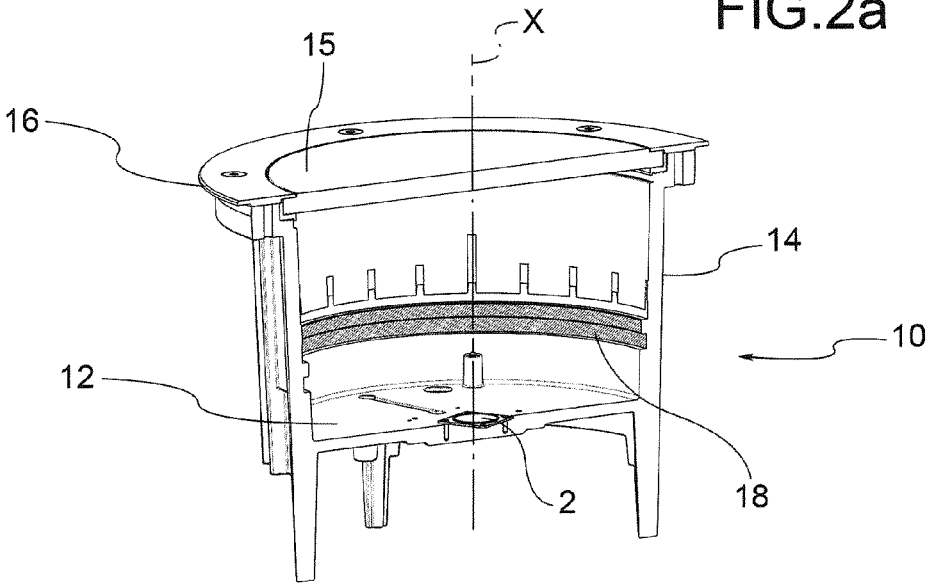
FIG. 3 is a perspective view, in axial cross-section of the external body of the appliance according to the invention.

In addition to these usual adjustments, it is possible to provide the lens with the possibility of a third axial movement away from/towards the source. Said axial movement thus provides a zoom of the beam of light, making it pass from a narrow beam, or "spot" (FIG. 2) to a wide beam, or "wide flood" (FIG. 2*a*).

Consequently, the invention is based on the idea of keeping the lighting source blocked, attaching it to the bottom of the appliance body, and instead moving the optics associated to the lighting source. The attachment of the lighting source to the bottom of the device body makes it possible to maximize the transmission of heat generated by the source towards said body.

With reference to FIGS. 3-12, an example of a practical embodiment of the invention will now be described.

Figure 12:
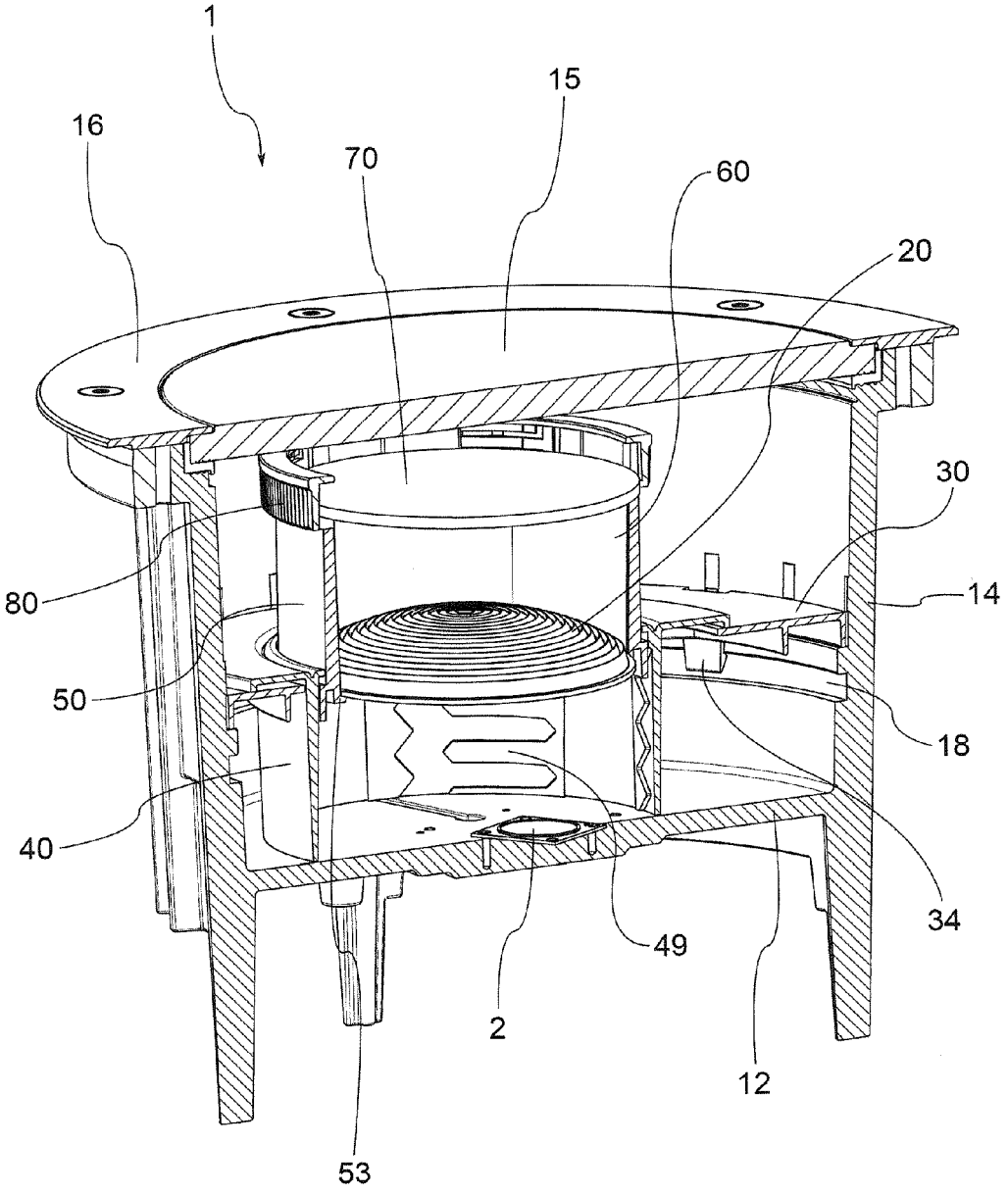
FIG. 12 is a perspective view, in axial cross-section, of the assembled appliance.

In said drawings, reference numeral 1 globally denotes an "inground" lighting device according to the invention (FIG. 12).

The appliance 1 comprises a substantially cylindrical cup-shaped external appliance body 10, comprising a bottom wall 12 and a side wall 14 which extends from said bottom wall 12. For example, said external body 10 is made of cast aluminium.

A lighting source 2, preferably LED, is attached to said bottom wall 12 of the external appliance body 10. Said source 2 is suitable to emit a beam of light with the main axis X perpendicular to the bottom wall 12.

In the case of an embedded appliance, the bottom wall 12 forms a horizontal plane on which the lighting source 2 lies. The main axis X is in this case a vertical axis.

A lens 20 is associated to the lighting source 2 suitable for focusing the beam of light. In a preferred embodiment, the lens 20 is a step lens (or Fresnel lens), made for example of transparent PMMA. The lens 20 has a convex shape which allows it to capture the highest number of rays emitted. The step structure makes it possible to produce the lens 20 with reduced thickness and permits its production by injection moulding.

The external appliance body 10 is closed, on the side opposite the bottom wall 12, by a glass 15 attached to the body for example by means of a locking ring 16.

Advantageously, the lighting source 2 is laid in permanent contact on the bottom wall 12 so as to maximise the conducting of heat towards said bottom wall 12.

According to the invention, the lighting device 1 further comprises lateral translation means suitable to cause a translation of the lens 20 on a lens plane orthogonal to said main axis X so as to offset the centre of the lens from said main axis X, and rotation means suitable to cause a rotation of the offset lens 20 on said lens plane around said main axis X.

A combination of translatory, or lateral, and rotational, or angular, displacements of the lens 20 is thus obtained, which makes it possible to orient the beam of light in any direction within a predetermined range, in accordance with the principle of misalignment mentioned above with reference to FIGS. 1-1*b*.

In a preferred embodiment, the appliance 1 further comprises axial translation means suitable to cause the axial translation of the lens 20 in relation to said emission axis so as to vary the angle of the beam of light, as described above with reference to FIGS. 2, 2*a*.

In one embodiment, said rotation means comprise a rotating plate 30 (FIG. 4) supported by the side wall 14 of the external appliance body 10 with the possibility of rotation around the main axis X. For example, the rotating plate 30 is made in a black plastic anti-glare material. The rotating plate may be provided, on the side facing the glass 15, with at least one projection, referred to as a locking knob, or simply knob 33 to facilitate its orientation.

Furthermore, in a preferred embodiment, the rotating plate 30 is provided with means for blocking its rotation in a desired position, as will be described below.

In said rotating plate 30 an eccentric aperture 32 is made of an elongated shape.

In one embodiment, the lateral translation means comprise a translation element 40 (FIG. 5) which supports the lens 20 and which engages said eccentric aperture 32. Said translation element 40 is supported by the rotating plate 30 with the possibility of lateral translation in said eccentric aperture 32.

Preferably, the translation element 40 is made of black plastic antiglare material For example, said translation element 40 can slide in relation to the rotating plate 30 by 20 mm to tilt the beam of light by about 20°.

In one embodiment, a guide groove 18 is made in the side wall 14 of the appliance body 10. The rotating plate 30 is provided with blocking teeth 34 which snap-engage said guide groove 18.

Figure 4:
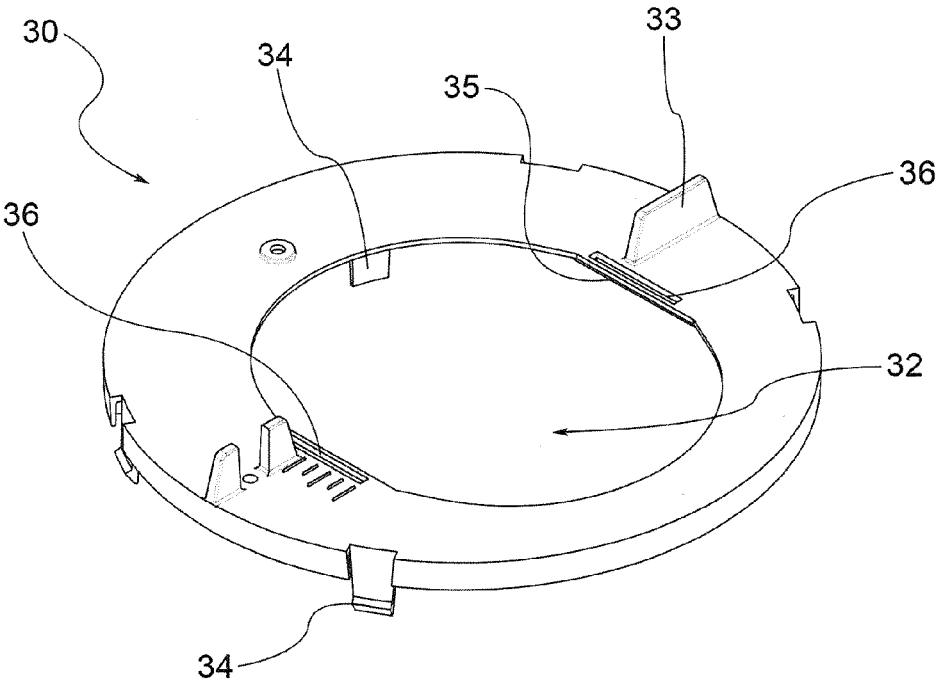
FIGS. 4-10 illustrate, in perspective view, as many components of the lighting device.
Figure 4A:
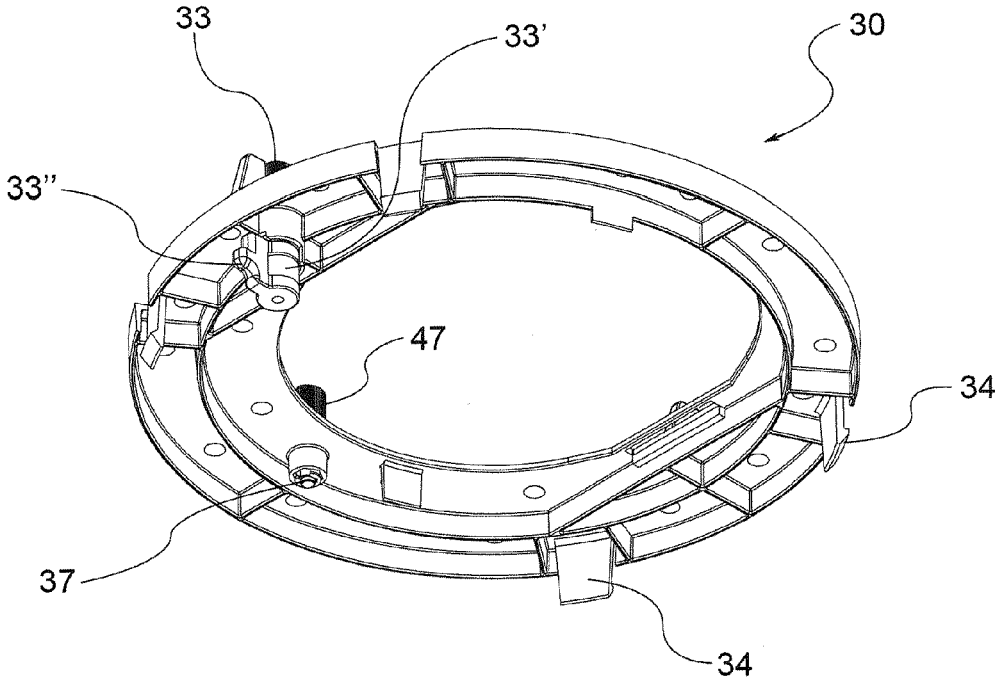
FIG. 4*a* is a perspective view from below of the rotating plate.
Figure 5:
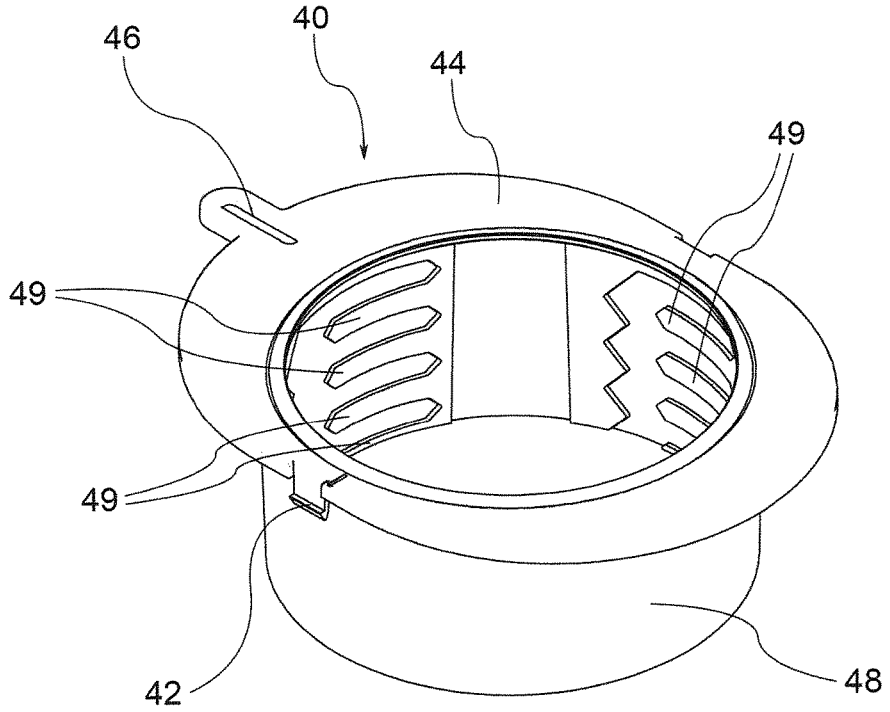

According to a preferred embodiment, illustrated in particular in FIG. 4*a*, the blocking means of the rotation of the rotating plate 30 comprise an angular locking knob (or simply, knob) 33 having a threaded shank which is screwed into a cylindrical element 33' which extends from the lower side of the rotating plate 30. Said cylindrical element 33' is provided with a radial tooth 33". The cylindrical element 33' can rotate, for example by 90°, between two abutments of the rotating plate. In particular, when the knob 33 is screwed into the cylindrical element 33', the radial tooth 33" is rotated outward so as to engage the guide groove 18 of the external body 10 and secure, in the way of a clamp, the rotating plate 30 to said guide groove 18. By unscrewing the knob 33, the radial tooth 33" first loosens and then rotates returning inside the diameter of the rotating plate 30, and thus disengaging from the guide groove 18 to allow a free rotation of the rotating plate 30.

According to one embodiment, the eccentric aperture 32 is defined by a rim which forms two parallel sides 35 in each of which a guide slot is made 36. The lateral translation element 40 is provided with coupling hooks 42 which snap engage said guide slots 36 with the possibility of lateral sliding.

Advantageously therefore the lateral translation means and the rotation means are suitable to permit a regulation of the position of the lens 20 in a continuous manner.

The translation element 40 has a rim 44 facing outwards which rests on the upper side of the rotating plate 30 and in which a radial slit 46 is made.

The translation element 40 is associated to a side blocking knob 47 having a threaded shank which passes through said radial slit 46 and is screwed into a nut 37 locked in a hexagonal seat made in the rotating plate 30 to clamp the translation element 40 to the rotating plate 30 in the desired position.

Figure 6:
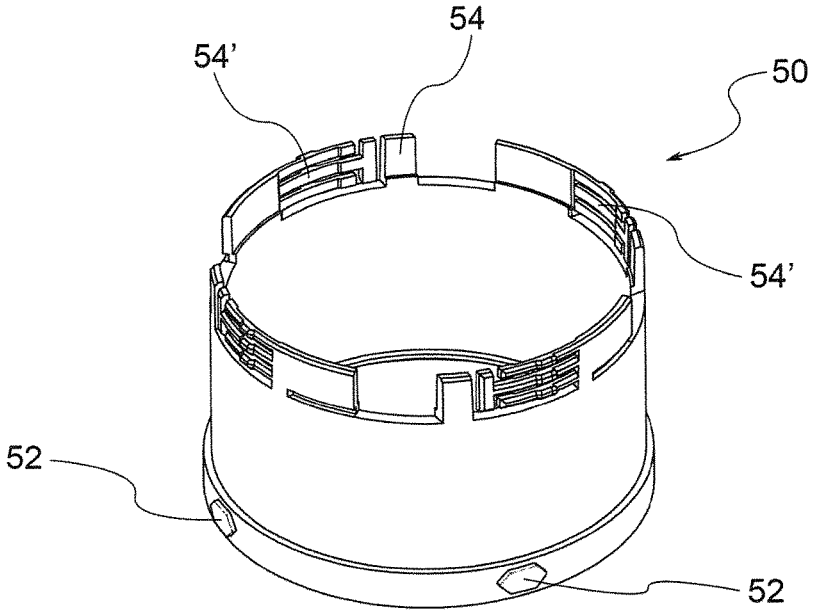
Figure 7:
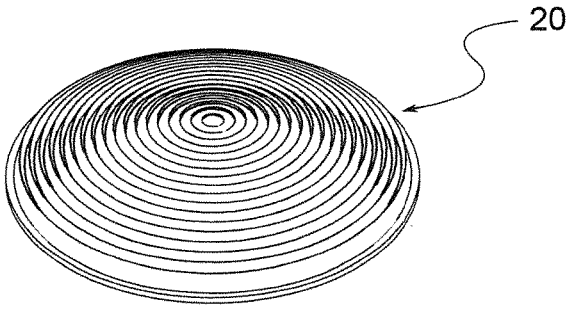
Figure 8:
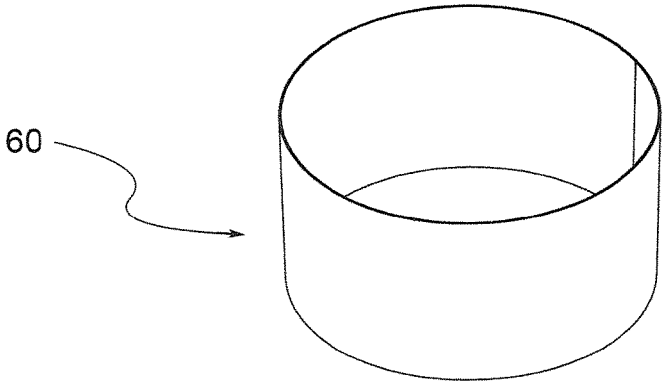
Figure 9:
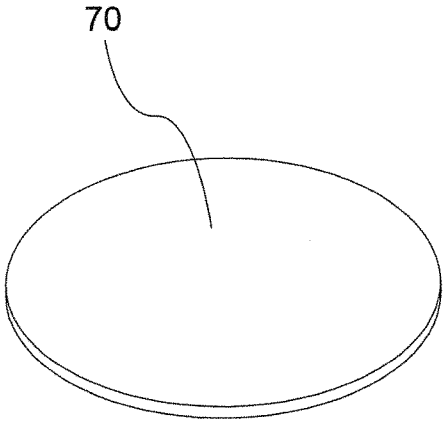
Figure 10:
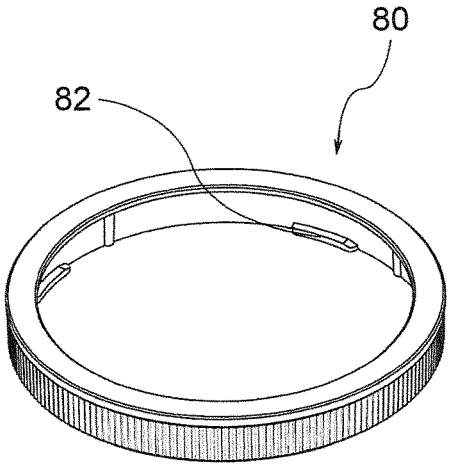
Figure 11:
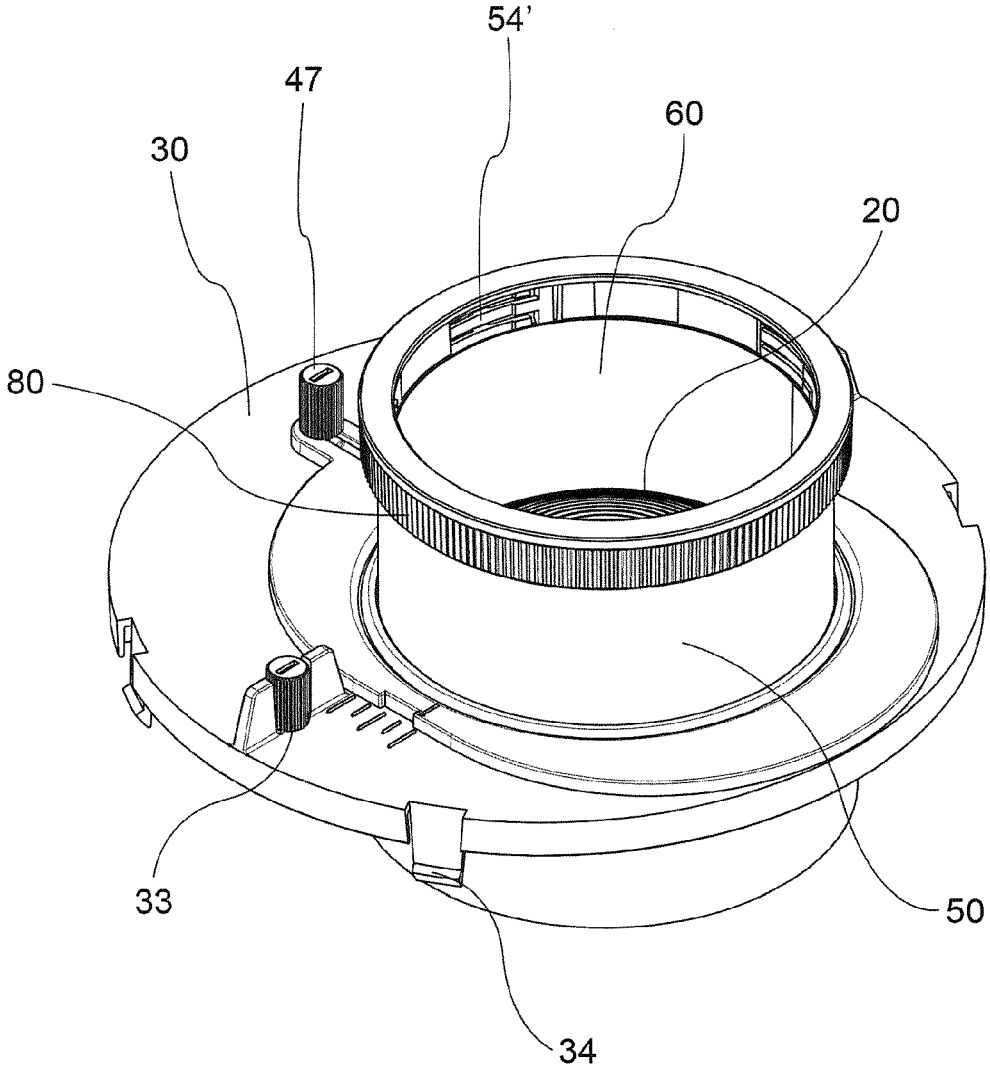
FIG. 11 shows, in perspective view, some components of the appliance assembled together.

In one embodiment, the lateral translation element 40 comprises a cylindrical side wall 48 which engages the eccentric aperture 32. A lens-holder element 50 of a cylindrical shape is inserted in said cylindrical side wall 48 (FIG. 6).

Advantageously, said lens holder element 50 is supported by the side translation element 40 with the possibility of adjusting its axial position with respect to said cylindrical side wall 48, so as to obtain a corresponding adjustment of the angle of the beam of light.

More specifically, in the inner side of said cylindrical side wall 48 a plurality of circular positioning grooves 49 are made, axially spaced from each other. The lens-holder element 50 is fitted with radial teeth 52 suitable to engage, for example by means of a bayonet coupling, one of said circular positioning grooves 49 so as to define the axial position of the lens-holder element 50 in relation to said cylindrical side wall 48.

As a result, said axial translation means are suitable to permit a stepped regulation of the axial position of the lens 20.

For example, the lens-holder element 50 can be axially positioned in four different vertical positions each corresponding to four beam apertures for a total movement of the lens of 40 mm (with steps of 13.3 mm each).

Preferably, the lens-holder element 50 is made of black plastic antiglare material.

In one embodiment, inside the lens-holder element 50 a cylindrical reflector 60 (FIG. 8) is inserted suitable to reflect the rays coming out of the lens 20. In other words, the reflector 60 forms a ray recovery cylinder around the lens 20. Preferably, said reflector 60 is made of specular high reflectance aluminium.

According to one embodiment, the lens-holder element 50 has a lens supporting rim 53 facing inwards to support the lens. Preferably, said lens supporting rim 53 is made at the end of the lens-holder element facing the lighting source 2. Preferably, the lens 20 is axially constrained to said rim 53 by the cylindrical reflector 60.

According to one embodiment, the appliance 1 further comprises a refractive filter 70 (FIG. 9) resting on the cylindrical reflector 60. The refractive filter 70 provides the level of light mixing needed to eliminate the slight chromatic aberrations of the lens 20. Preferably, said filter 70 is glass.

More in detail, in one embodiment the lens-holder element 50 terminates, on the side facing the glass 15, with a filter-holder crown 54 provided with elastic locking teeth 54' suitable to allow the securing of the filters 70.

The appliance 1 comprises a filter loop 80 (FIG. 10) provided with hooking teeth 82 for coupling, for example by means of a bayonet coupling, the filter-holder crown 54 of the lens-holder element 50 so that, by rotating said filter ring 80 the closure of the elastic locking teeth 54' on one or more filters 80 is caused.

It is evident from the above that the appliance according to the invention makes it possible to achieve the purpose of allowing a broad adjustment of the orientation of the beam of light and at the same time guaranteeing an optimal dissipation of the heat generated by the lighting source, thanks to the permanent contact between the source and the device body.

In addition, the implementation of a variable beam angle in the context of applications of an "inground" appliance is particularly advantageous. Consider, for example, in a large installation, the inconvenience of having to choose and order a priori fixed and immutable beam angles only to discover on site not to have chosen the correct ones.

The lighting device makes it possible to overcome such a drawback and also offers the advantage of having in stock a single appliance code instead of three or four appliances with different codes.

The device described in addition makes it possible to change the effect or the lighting design over time.

It is to be noted that the lighting source can be made with a single monochromatic LED module, with a set of monochromatic LEDs or with a set of LEDs of different colours (RGB or CTC colour-change function).

A person skilled in the art may make modifications and variations to the embodiments of the lighting device according to the invention, replacing elements with others functionally equivalent so as to satisfy contingent requirements while remaining within the scope of protection of the following claims. Each of the characteristics described as belonging to a possible embodiment may be realised independently of the other embodiments described.

The invention claimed is:

1. A lighting device, in particular suitable for being embedded in the ground, comprising:

an external appliance body, of a substantially cylindrical shape, comprising a bottom wall and a side wall which extends from said bottom wall;

a lighting source attached to said bottom wall of the external appliance body and suitable to emit a beam of light with a main axis (X);

a lens suitable to focus said beam of light;

lateral translation means suitable to cause a translation of the lens on a lens plane orthogonal to said main axis so as to offset the centre of the lens from said main axis; and rotation means suitable to cause a rotation of the offset lens on said lens plane around said main axis, wherein said rotation means comprise a rotating plate supported by the side wall of the external appliance body, wherein the rotating plate is configured to rotate around the main axis (X), and wherein said rotating plate also comprises an eccentric aperture of an elongated shape; and wherein said lateral translation means comprise a translation element which supports the lens and which engages said eccentric aperture, said translation element being supported by the rotating plate and wherein the translation element is configured to be laterally translated in said eccentric aperture.

2. The lighting device according to claim 1, wherein the lighting source is kept in permanent contact with the bottom wall so as to maximise the conducting of heat towards said bottom wall.

3. The lighting device according to claim 1, further comprising axial translation means suitable to cause an axial translation of the lens in relation to said main axis so as to vary the aperture of the beam of light.

4. The lighting device according to claim 1, wherein at least said lateral translation means and said rotation means are suitable to permit a regulation of the position of the lens in a continuous manner.

5. The lighting device according to claim 1, wherein at least said lateral translation means and said rotation means are provided with lateral blocking means and angular blocking means suitable to block the lens in a desired lateral and angular position.

6. The lighting device according to claim 5, wherein the translation element has a rim facing radially outwards in which a radial slit is made, the angular blocking means comprising a knob having a threaded stem which crosses said radial slit and screws into a nut blocked in a respective seat made in the rotating plate to clamp the translation element to the rotating plate in a desired position.

7. The lighting device according to claim 1, wherein said axial translation means are suitable to permit a stepped regulation of the axial position of the lens.

8. The lighting device according to claim 1, wherein a guide groove is formed in the side wall of the external appliance body, and wherein the rotating plate is provided with blocking teeth which snap engage said guide groove.

9. The lighting device according to claim 1, wherein said eccentric aperture is defined by a rim which forms two parallel sides in each of which a guide slit is made, and wherein the lateral translation element is provided with coupling hooks which snap engage said guide slit so as to permit a translation of the lateral translation element in relation to the rotating plate.

10. The lighting device according to claim 1, wherein the lateral translation element comprises a cylindrical side wall which engages the eccentric aperture, and wherein a lens-holder element of a cylindrical shape is inserted in said cylindrical side wall, wherein an axial position of the lens-holder element is configured to be regulated in relation to said cylindrical side wall.

11. The lighting device according to claim 10, wherein in the inner side of said cylindrical side wall a plurality of circular positioning grooves are made, axially distanced from each other, and wherein the lens-holder element is fitted with radial teeth suitable to engage one of said plurality of circular positioning grooves so as to define the axial position of the lens-holder element in relation to said cylindrical side wall.

12. The lighting device according to claim 10, wherein a cylindrical reflector is inserted inside the lens-holder element, wherein the cylindrical reflector is suitable to reflect the rays coming out of the lens.

13. The lighting device according to claim 12, wherein the lens-holder element has a lens supporting rim facing inwards to support the lens, and wherein the lens is axially retained to said lens supporting rim by said cylindrical reflector.

14. The lighting device according to claim 12, further comprising at least one refractory filter lying on the cylindrical reflector.

15. The lighting device according to claim 10, wherein the lens-holder element ends with a filter-holder crown provided with elastic locking teeth suitable to permit the clamping of one or more refractory filters.

16. The lighting device according to claim 15, comprising a filter ring fitted with coupling teeth for a coupling to the filter-holder crown, wherein rotating said filter ring closes the elastic locking teeth on the filters.

* * * * *